US006208192B1

(12) United States Patent
Liu et al.

(10) Patent No.: US 6,208,192 B1
(45) Date of Patent: Mar. 27, 2001

(54) FOUR-QUADRANT MULTIPLIER FOR OPERATION OF MOSFET DEVICES IN SATURATION REGION

(75) Inventors: Shen-Iuan Liu; Jing-Shawn Wu; Yuh-Shang Hwang, all of Taipei (TW)

(73) Assignee: National Science Council, Taipei (TW)

( * ) Notice: Subject to any disclaimer, the term of this patent is extended or adjusted under 35 U.S.C. 154(b) by 0 days.

(21) Appl. No.: 08/991,625

(22) Filed: Dec. 5, 1997

Related U.S. Application Data

(60) Provisional application No. 60/032,519, filed on Dec. 5, 1996.

(51) Int. Cl.[7] ..... G06G 7/16

(52) U.S. Cl. ..... 327/357; 327/359; 455/333

(58) Field of Search ..... 327/356, 357, 327/359, 116, 119–122; 455/326, 333

(56) References Cited

U.S. PATENT DOCUMENTS

| | | | | |
|---|---|---|---|---|
| 5,187,682 | * | 2/1993 | Kimura | 327/356 |
| 5,774,010 | * | 6/1998 | Kimura | 327/359 |
| 5,805,007 | * | 9/1998 | Colli | 327/357 |
| 5,886,560 | * | 3/1999 | Kimura | 327/357 |

* cited by examiner

*Primary Examiner*—Kenneth B. Wells

(74) *Attorney, Agent, or Firm*—Jacobson, Price, Holman & Stern, PLLC

(57) ABSTRACT

The invention relates to an improved four-quadrant squarer circuit based on the square-law characteristic of metal oxide-semiconductor field effect transistors (MOSFETs). According to the invention, a CMOS four-quadrant multiplier is provided which is arranged to keep the operating transistors fixed in the saturation region, so that they continuously operate according to the square law, and the circuit of the invention allows the transistors to operate in the saturation region with a wide input range.

7 Claims, 4 Drawing Sheets

FOUR-QUADRANT MULTIPLIER FOR OPERATION OF MOSFET DEVICES IN SATURATION REGION

This application claims the benefit of U.S. Provisional Application No. 60/032,519 filed on Dec. 5, 1996.

BACKGROUND OF THE INVENTION

1. Field of the Invention

The present invention relates to a four-quadrant multiplier circuit and a squarer circuit. In particular, the invention relates to four-quadrant multiplier and squarer circuits which have an improved input range and better frequency and improved frequency response by exploiting the squarer-law characteristics of MOS transistors biased in the saturation region.

2. Description of the Prior Art

Four-quadrant multipliers are well known circuits which are often used as building blocks in larger circuit arrangements, such as adaptive filters, frequency doublers, and modulator circuits. In 1974, B. Gilbert proposed a bi-polar junction transistor (BJT) based multiplier, employing Gilbert cells. The proposal issued in an article "A High Performance Monolithic Multiplier Using Active Feedback," IEEE Journal Of Solid State Circuits, SC 9, pp. 264–377. In 1982, D. C. Soo and R. G. Meyer used the Gilbert cell concept to design a n-channel metal-oxide-semiconductor (NMOS) four-quadrant multiplier. However, Gilbert cells consume large amounts of power and provide a limited input range.

Accordingly, S. I. Liu et al. designed a complementary metal-oxide-semiconductor (CMOS) four-quadrant multiplier, using squarer-law characteristics of metal-oxide-semiconductor field effect transistors (MOSFETs) operating in their saturation region. This design was published in 1993 in the Electronics Letter, Vol. 29, pp. 1737–1738. In the same year, S. I. Liu et al. also described the design of a multiplier using the characteristics of MOSFETs in their linear region, in an article entitled "Non-Linear Circuit Applications With Current Conveyors," IEEE Proceedings-G, Vol. 140, pp. 1–6.

As discussed above, analog multipliers have been proposed which employ the characteristics of MOS devices operating in both the saturation and the linear regions. The use of MOS devices reduces power consumption, as compared to the use of bi-polar junction transistors. However, utilizing MOS transistors which are biased to operate in a linear region allows only a small input range, and provides poor frequency response. Therefore, traditional CMOS multipliers have only a narrow input range and poor frequency response, which must be improved without increasing power consumption or manufacturing costs of the multipliers.

SUMMARY AND OBJECTS OF THE INVENTION

It is an object of the invention to provide an improved four-quadrant squarer circuit based upon the square-law characteristic of metal oxide-semiconductor field effect transistors (MOSFETs). It is another object of the invention to provide an improved multiplier circuit based upon the square-law operating characteristics of MOSFETs.

It is known in the art that a MOSFET device, operating in the saturation region, has a current-voltage transfer function which follows the square law. More specifically, the drain current $I_d$ of a field effect transistor operating in the saturation region is proportional to $(V_{GS}-V_T)^2$, where $V_T$ is the gate threshold voltage at which drain current begins and $V_{GS}$ is the voltage between the gate and the source of the transistor. This square-law operating characteristics of MOSFETs can be employed to realize the general mathematical formula $(A+B)^2-(A-B)^2=4AB$. Accordingly, a simple circuit employing the square-law operating characteristics of MOSFET devices will be able to provide both a squarer and a multiplier which are suitable for high frequency operation.

According to the invention, a CMOS four-quadrant multiplier is provided which is arranged to keep the operating transistors fixed in the saturation region, so that they continuously operate according to the square law described above. Further, the circuit allows the transistors to operate in the saturation region with even a wide range of input.

DETAILED DESCRIPTION OF THE INVENTION

Figure 1:
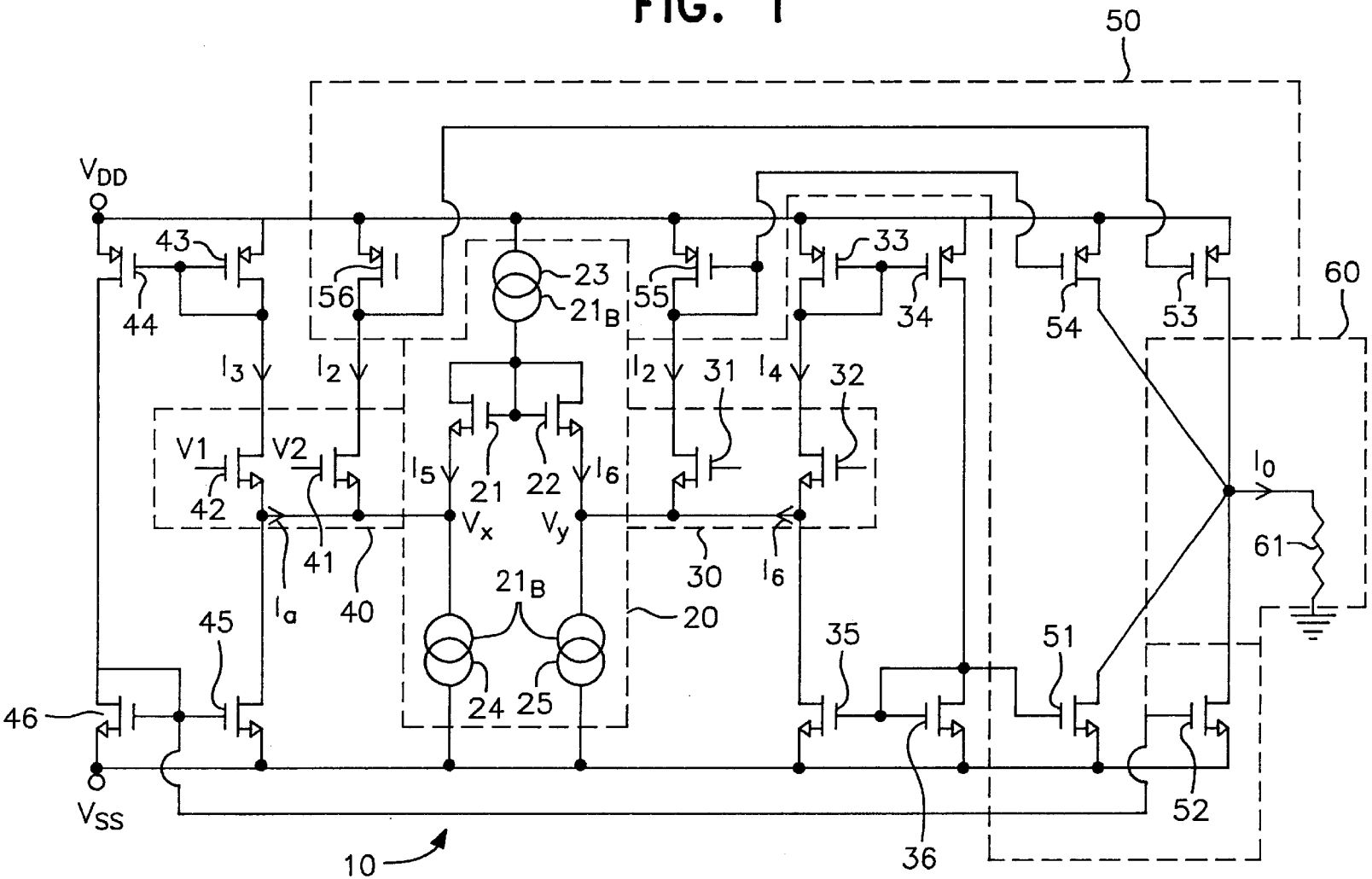
FIG. 1 is a circuit diagram showing a CMOS squarer circuit according to a first embodiment of the invention.

Turning now to FIG. 1, a squarer circuit 10 according to a first embodiment of the invention is shown. The squarer circuit 10 includes a DC current supply circuit 20 and two differential input circuits 30 and 40. The squarer circuit 10 also includes current transfer circuit 50 and output portion 60.

The DC current supply circuit 20 has two (NMOS) field effect transistors 21 and 22 arranged to form a current mirror. The DC current supply circuit 20 also has two "output" nodes, labeled in FIG. 1 as $V_X$ and $V_Y$, and three constant current sources 23, 24, and 25, which each produce a constant current value $2I_B$. Thus, the DC current supply circuit 20 provides a constant current source $2I_B$ between each of output nodes $V_X$ and $V_Y$ and the source supply voltage ($V_{SS}$). The DC current supply circuit 20 also ensures the constant current source $2I_B$ between the drain supply voltage ($V_{DD}$) and the drains of field effect transistors 21 and 22.

The first differential input circuit 30 includes two NMOS field effect transistors 31 and 32. Transistor 32 is biased by two p-channel metal-oxide-semiconductor (PMOS) field effect transistors 33 and 34, and by two NMOS field effect transistors 35 and 36. The gate of field effect transistor 31 serves as a terminal for differential voltage level $V_2$ of the differential input signal, while the gate of field effect transistor 32 serves as a terminal for differential voltage level $V_1$ of the differential input signal. The source electrodes of field effect transistors 31 and 32 are both connected to the output $V_Y$ of the DC current supply circuit 20.

Similarly, the second differential input circuit 40 includes two NMOS field effect transistors 41 and 42. Like transistor 32, transistor 42 is biased by two PMOS field effect transistors 43 and 44, and by two NMOS field effect transistors 45 and 46. The gate of field effect transistor 41 also serves as a terminal for differential voltage level $V_1$ of the differential input signal, while the gate of field effect transistor 42 serves as a terminal for voltage level $V_2$ of the differential input signal. The source electrodes of field effect transistors 41 and 42 are both connected to the output $V_X$ of the DC current supply circuit 20.

The current transfer circuit 50 has two NMOS field effect transistors 51 and 52. The current transfer circuit also has four PMOS field effect transistors 53, 54, 55, and 56. The current transfer circuit 50 reproduces the drain currents of the first and second differential input circuits 30 and 40, as will be explained below. Output portion 60 includes a load resistor 61, for drawing the output current $I_O$, as will also be explained below.

Preferably, the channel width-to-length ratios of each of the PMOS transistors are the same. Also, it is preferable that the channel width-to-length ratios of each of the six NMOS transistors in the differential input circuits 30 and 40 and the current transfer circuit (i.e., transistors 21, 22, 31, 32, 41, and 42) be the same. Further, the remaining NMOS transistors 35, 36, 45, 46, 51, and 52 should share the same channel width-to-length ratios.

Referring now to the operation of the squarer circuit 10, when the differential voltage levels $V_1$ and $V_2$ are applied to the second differential input circuit 40, the transistors in the second differential input circuit 40 produces drain currents. More specifically, when the differential voltage level $V_1$ is applied to the gate of transistor 42, and the differential voltage level $V_2$ is applied to the gate of transistor 41, transistor 41 is activated to draw a drain current $I_1$, while field effect transistor 42 is activated to draw a drain current $I_3$.

Similarly, when the differential voltage is applied to the first differential input circuit 30, the first differential input circuit 30 also produces drain currents. That is, when differential voltage level $V_1$ is applied to transistor 32 and differential voltage level $V_2$ is applied to transistor 31, transistor 31 is activated to draw a drain current I2, while field effect transistor 32 is activated to draw a drain current $I_4$.

As will be understood by those of ordinary skill in the art, transistors 43, 44, 45, and 46 are arranged to form a current mirror which reduces current $I_a$ (the current flowing from the source of transistor 42 to constant current source 24) to zero. Similarly, transistors 33, 34, 35, and 36 are arranged to form a current mirror which reduces current $I_b$ (the current flowing from the source of transistor 32 to the constant current source 25) to zero. Thus, the current $2I_B$ provided by constant currents sources 23, 24, and 25 is equal to $I_1+I_5$, $I_5+I_6$, and $I_6+I_2$, where $I_5$ is the source current for transistor 21 and $I_6$ is the source current for transistor 22.

The four drain currents $I_1$, $I_2$, $I_3$, and $I_4$ are reproduced at the output portion 60 by the current transfer circuit 50. Transistor 51 of current transfer circuit 50 is connected to first differential input circuit transistor 32, through transistors 33, 34, 35, and 36, so that transistor 51 draws drain current $I_4$. In the same fashion, transistor 52 is connected to second differential input circuit transistor 42, through transistors 43, 44, 45, and 46, so that transistor 52 draws drain current $I_3$.

Transistors 53 and 56 of the current transfer circuit 50 are connected to the second differential input circuit transistor 41 such that transistor 53 produces source current $I_1$. Also, transistors 54 and 55 of the current transfer circuit 50 are connected to the first differential input circuit transistor 31 such that transistor 54 produces source current $I_2$.

Thus, the current $I_O$ being supplied to resistor 61 of output portion 60 is determined by the formula (1):

$$I_O=I_1+I_2-I_3-I_4 \tag{1}$$

As noted before, the drain current provided by a MOS field effect transistor is proportional to the square of the difference between the gate-source voltage $V_{GS}$ and the gate threshold voltage $V_T$. More specifically, the current voltage response characteristics of a field effect transistor operating in the saturation region is controlled by the formula (2):

$$I_D-k(V_{GS}-V_T)^2 \tag{2}$$

where $I_D$ is the drain current, k is the transconductance parameter of the transistor, $V_{GS}$ is the voltage between the gate and the source, and $V_T$ is the gate threshold voltage at which drain current begins. In the squarer circuit 10 shown in FIG. 1, each of the field effect transistors is operating in the saturation region. Therefore, each of the transistors exhibits the current-voltage characteristics as defined in formula (2).

Turning now to the DC current supply circuit 20 and the first and second differential input circuits 30 and 40, it will be understood that the voltage at output nodes $V_X$ and $V_Y$ is a function of the differential voltage applied to transistors 31, 32, 41 and 42 (i.e., the voltage levels $V_1$ and $V_2$), the transconductance parameter k of the transistors, the gate threshold voltage $V_T$ of the transistors, and the constant current $I_B$ provided by the current mirror. More specifically, the current supply circuit 20 and the first and second differential input circuits 30 are arranged such that $V_X$ and $V_Y$ are given by the following formulas (3) and (4):

$$V_X + V_T = \frac{3V_1 + V_2}{4} - \frac{I_B}{k} - \frac{(V_1 - V_2)^2}{16} \tag{3}$$

$$V_Y + V_T = \frac{V_1 + 3V_2}{4} - \frac{I_B}{k} - \frac{(V_1 - V_2)^2}{16} \tag{4}$$

Employing formulas (2), (3), and (4), formula (1) can be simplified as follows:

$$I_O = I_1 + I_2 - I_3 - I_4 \quad (1)$$
$$= k(V_1 - V_X - V_T)^2 + k(V_2 - V_Y - V_T)^2 - k(V_1 - V_X - V_T)^2 - k(V_1 - V_X - V_T)^2$$
$$= -k(V_1 - V_2)^2 \quad (5)$$

From formula (5), it will be understood that the squarer circuit 10 provides an output current $I_O$ to resistor 61 which is proportional to the square of the differential voltage.

The squarer circuit 10 according to the invention was simulated using the well-known circuit simulator program SPICE. The squarer circuit 10 was simulated assuming the following parameters:

$$V_{TN} = 0.8\,\text{V} \qquad V_{TP} = -0.85\,\text{V}$$
$$k_p = 13.1\ \mu\text{A}/V^2 \qquad k_n = 36.9\,\mu\text{A}/V^2$$
$$V_{DD} = 5\,\text{V} \qquad V_{SS} = -5\,\text{V}$$
$$2I_B = 52.4\ \mu\text{A} \qquad R_L = 50\,\text{k}\Omega$$

where $R_L$ is resistor 61 in output portion 60.

It was also assumed that the width-to-length ratios of the PMOS transistors be 60 $\mu$m:10 $\mu$m. Using the 3 $\mu$m p-well process, the width-to-length ratios of the NMOS transistors 21, 22, 31, 32, 41, and 42 were assumed to be 30 $\mu$m:50 $\mu$m, while the width-to-length ratios of the remaining NMOS transistors were assumed to be 20 $\mu$m:10 $\mu$m.

Figure 2:
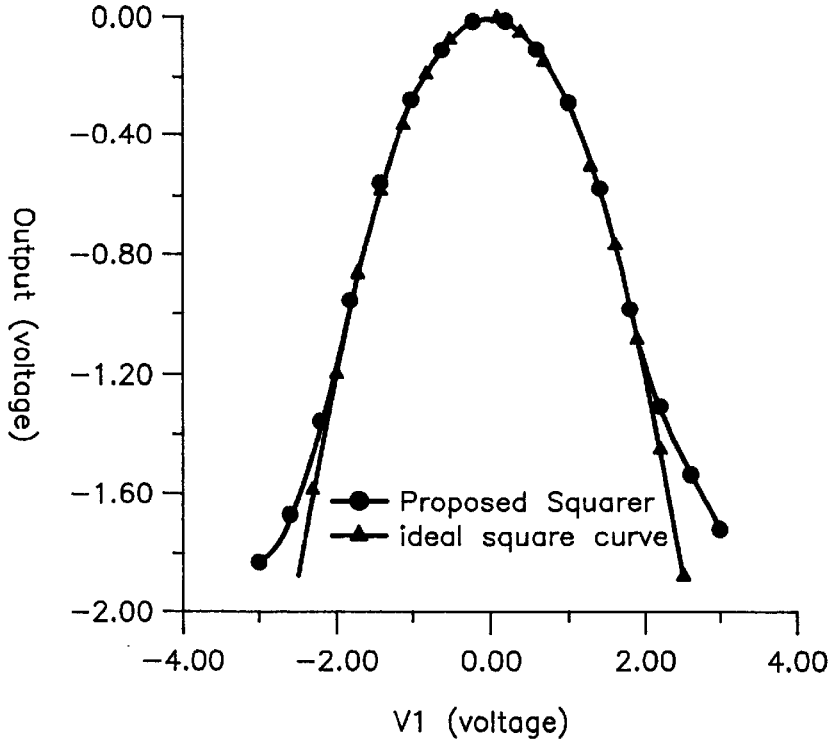
FIG. 2 is a graph showing the comparison between a simulated typical output of the squarer circuit shown in FIG. 1 and an ideal squarer curve.

FIG. 2 is a graph illustrating the transfer function of the simulated squarer circuit 10, with differential voltage level $V_2$=0 V. FIG. 2 also illustrates the transfer function of an ideal squarer with differential voltage level $V_2$=0 V. As can be seen from this figure, the transfer function of the simulated squarer circuit 10 deviates from the transfer function of the ideal squarer by less than 1% over the ±1.95 V input range. Thus, FIG. 2 graphically demonstrates the accuracy and range of the squarer circuit 10 according to the invention.

In addition, an analysis of the total harmonic distortion (THD) was made for the squarer circuit 10 using SPICE. The analysis indicates that, when the differential voltage level $V_2$=0 V, and the differential voltage level $V_1$ varied over the range ±1.95 V, the total harmonic distortion for the squarer circuit 10 was less than 1.5%.

Figure 3:
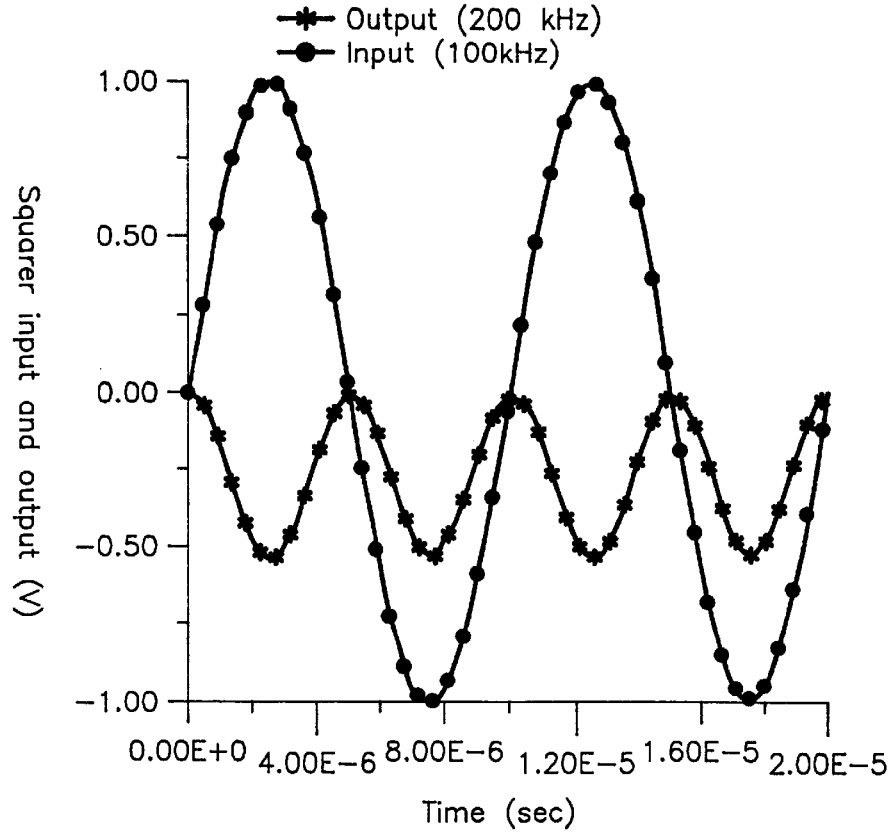
FIG. 3 is a graph showing time domain simulations of the squarer circuit of FIG. 1 used as a frequency doubler.

FIG. 3 graphically illustrates the use of the simulated squarer circuit 10 as a frequency doubler. More specifically, this figure graphically depicts a SPICE simulation where a −2 $V_{p\text{-}p}$ sinusoidal signal having a frequency of 100 kHz was applied as differential voltage level $V_1$ to the squarer circuit 10, while the differential voltage level $V_2$ was set to zero. As seen in FIG. 3, the output signal of the simulated squarer circuit 10 had a frequency of 200 kHz. Thus, the squarer circuit 10 according to the invention effectively operates as a frequency doubler.

In the squarer circuit 10 of the invention discussed above, the same differential voltage ($V_1$–$V_2$) is applied as an input to both the first differential input circuit 30 and the second differential input circuit 40. However, it is also possible to provide a multiplier circuit according to the invention, which will multiply two distinct differential voltages.

Figure 4:
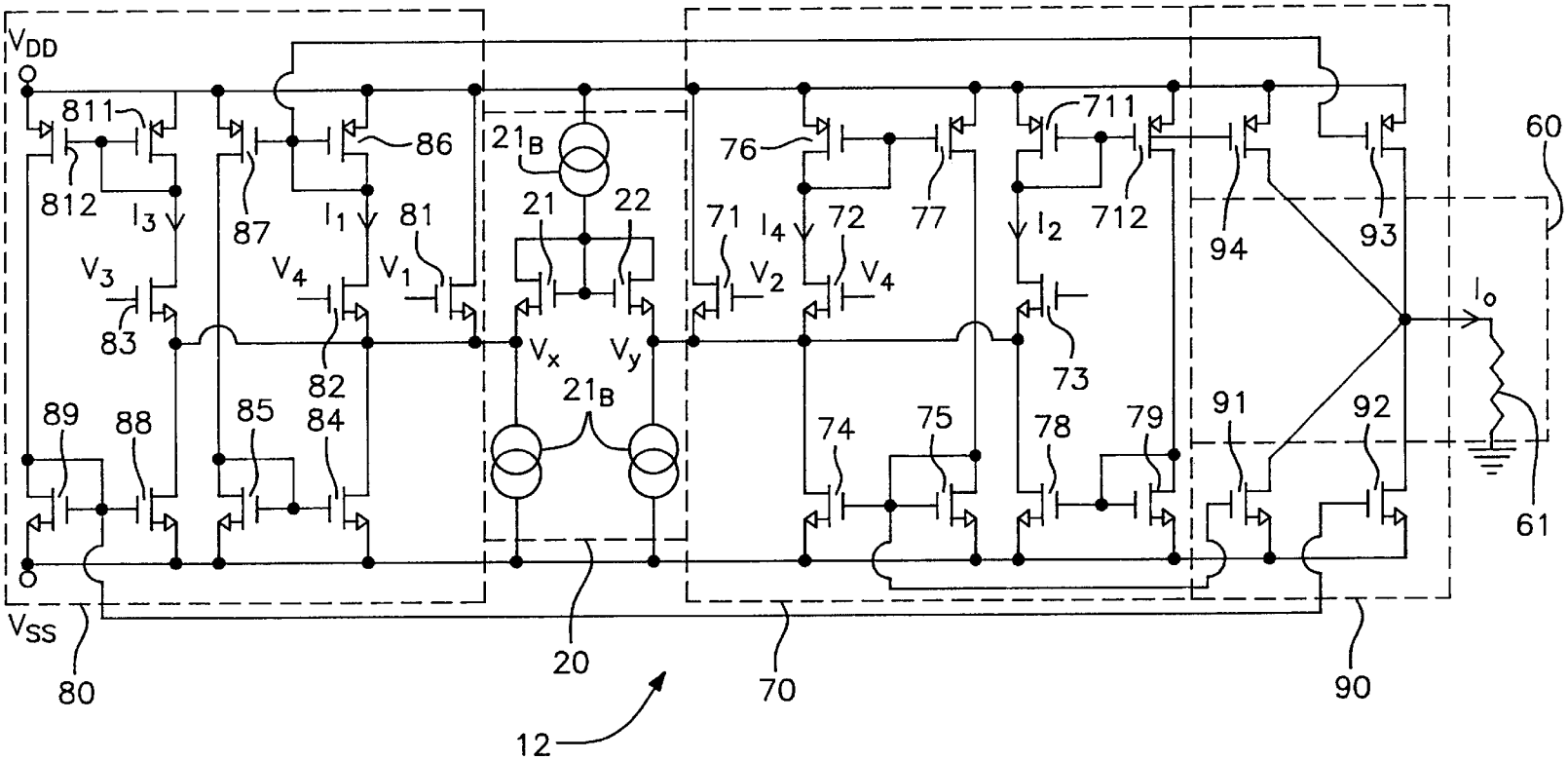
FIG. 4 is a circuit diagram showing a four-quadrant multiplier circuit according to another embodiment of the invention.

The multiplier circuit 12 according to the invention is shown in FIG. 4. The multiplier circuit 12 includes a current supply circuit 20 like that of squarer circuit 10, with field effect transistors 21 and 22, and a constant current source $2I_B$ between each of output nodes $V_X$ and $V_Y$ and the source supply voltage ($V_{SS}$). The multiplier circuit 12 also includes an output portion 60 like that of the squarer circuit 10, with load resistor 61.

However, in order to multiply two distinct differential input signals, the multiplier circuit 12 has first and second differential input circuits 70 and 80, which are different from the first and second differential input circuits 30 and 40 of squarer circuit 10. The multiplier circuit 12 also has a current transfer circuit 90, which is different from the current transfer circuit 50 of squarer circuit 10.

The first differential input circuit 70 includes three NMOS field effect transistors 71, 72, and 73. The transistor 72 is biased by two NMOS field effect transistors 74 and 75, and by two PMOS field effect transistors 76 and 77. Similarly, the transistor 73 is biased by two NMOS field effect transistors 78 and 79, and two PMOS field effect transistors 711 and 712.

As noted before, the multiplier circuit 12 multiplies two distinct differential voltages. The first differential voltage is defined as $V_1$–$V_2$, while the second differential voltage is defined as $V_3$–$V_4$. The gate of field effect transistor 71 is connected to differential voltage level $V_2$ of the first differential input signal. The gate of field effect transistor 72 is connected to differential voltage level $V_4$ of the second differential input signal, while the gate of field effect transistor 73 is connected to differential voltage level $V_3$ of the second differential voltage. The source electrodes of field effect transistors 71, 72 and 73 are each connected to the output $V_Y$ of the DC current supply circuit 20.

The second differential input circuit 80 also includes three NMOS field effect transistors 81, 82, and 83. The transistor 82 is biased by two NMOS field effect transistors 84 and 85, and by two PMOS field effect transistors 86 and 87. The transistor 83 is biased by two NMOS field effect transistors 88 and 89, and two PMOS field effect transistors 811 and 812. The gate of field effect transistor 81 is connected to differential voltage level $V_1$ of the first differential input signal. The gate of field effect transistor 82 is connected to differential voltage level $V_4$ of the second differential input signal, while the gate of field effect transistor 83 is connected to differential voltage level $V_3$ of the second differential voltage. The source electrodes of each of field effect transistors 81, 82 and 83 are connected to the output $V_X$ of the DC current supply circuit 20.

Transfer current circuit 90 has two NMOS field effect transistors 91 and 92, and two PMOS field effect transistors 93 and 94. Transistor 91 is connected to transistor 72 of the first differential input circuit 70 through transistors 74, 75, 76, and 77, while transistor 92 is connected to transistor 83 of the second differential input circuit 80 through transistors 88, 89, 811, and 812. Transistor 93 is connected to transistor 82 of the second differential input circuit 80 through transistors 84, 85, 86, and 87, while transistor 94 is connected to transistor 73 of the first differential input circuit 70 through transistors 78, 79, 711, and 712.

The operation of multiplier 12 is similar to that of squarer circuit 10 described above. When the first and second differential voltages are applied to the first and second differential input circuits, the transistors in the first and second differential input circuits 70 and 80 each produce drain currents. More specifically, when differential voltage level $V_1$ is applied to the gate of transistor 81, differential voltage level $V_4$ is applied to the gate of transistor 82, and differential voltage level $V_3$ is applied to the gate of transistor 83, field effect transistor 82 is activated to draw a drain current $I_1$, while field effect transistor 83 is activated to draw a drain current $I_3$.

Likewise, when differential voltage level $V_2$ is applied to the gate of transistor 71, differential voltage level $V_4$ is applied to the gate of transistor 72, and differential voltage level $V_3$ is applied to the gate of transistor 73, field effect transistor 73 is activated to draw a drain current $I_2$, while field effect transistor 72 is activated to draw a drain current $I_4$.

As with the squarer circuit 10, the four drain currents $I_1$, $I_2$, $I_3$, and $I_4$ are reproduced at the output portion 60 by the current transfer circuit 90.

Transistor 91 of current transfer circuit 90, connected to the first differential input circuit transistor 72 through transistors 74, 75, 76, and 77, draws drain current $I_4$. Transistor 92, connected to the second differential input circuit transistor 83 through transistors 88, 89, 811, and 812, draws drain current $I_3$. Transistor 93, connected to the second differential input circuit transistor 82 through transistors 84, 85, 86, and 87, draws drain current $I_1$, while transistor 94, connected to first differential input circuit transistor 73 through transistors 78, 79, 711 and 712, draws drain current $I_2$. Thus, like in the squarer circuit 10, the current $I_O$ being supplied to resistor 61 of output portion 60 also is determined by the formula (1):

$$I_O=I_1+I_2-I_3-I_4 \tag{1}$$

However, the arrangement of the first and second differential input circuits 70 and 80, along with their connection to two different differential voltages, provides that $I_O$ is defined by the following formula (6):

$$I_O=k(V_1-V_2)\,(V_3-V_4) \tag{6}$$

Accordingly, the output current $I_O$ delivered across output resistor 61 is proportional to the multiplication of the first differential voltage $(V_1-V_2)$ by the second differential voltage $(V_3-V_4)$.

The multiplier circuit 12 also was simulated using the SPICE circuit simulator program. Like the squarer circuit 10, the multiplier circuit 12 was simulated assuming the following parameters:

$$V_{TN}=0.8\,\text{V} \qquad V_{TP}=-0.85\,\text{V}$$

$$k_p=13.1\ \mu\text{A}/V^2 \qquad k_n=36.9\,\mu\text{A}/V^2$$

$$V_{DD}=5\,\text{V} \qquad V_{SS}=-5\,\text{V}$$

$$2I_B=64\ \mu\text{A} \qquad R_L=50\,\text{k}\Omega$$

where $R_L$ is resistor 61 in output portion 60.

It was also calculated that the width-to-length ratios of the PMOS transistors be 50 $\mu$m:5 $\mu$m. Using the 3 $\mu$m p-well process, the width-to-length ratios of the NMOS transistors 21, 22, 71, 72, 73, 81, 82, and 83 were designated to be 6 $\mu$m:66 $\mu$m, while the width-to-length ratios of the remaining NMOS transistors were assumed to be 35 $\mu$m:5 $\mu$m.

Figure 5:
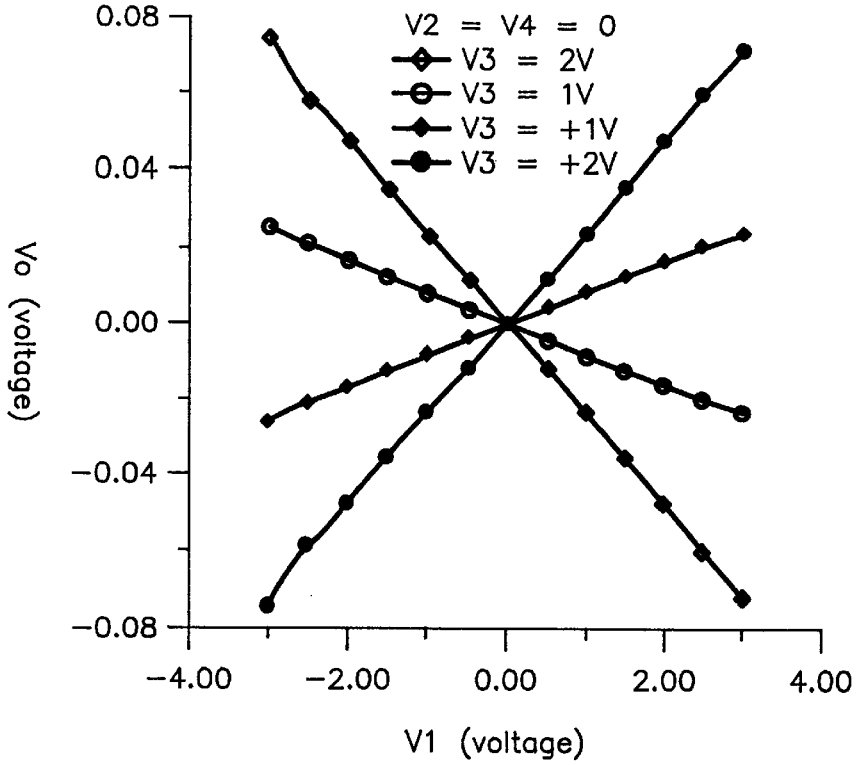
FIG. 5 is a graph illustrating simulated DC transfer curves for the multiplier circuit shown in FIG. 4.

FIG. 5 illustrates DC transfer curves for the simulated multiplier 12 with differential voltage levels $V_2$ and $V_4$ being designated as zero. In FIG. 5, the differential voltage level $V_1$ varies from −3 V to +3 V, while the differential voltage level $V_3$ varies from +2 V to −2 V.

Figure 6:
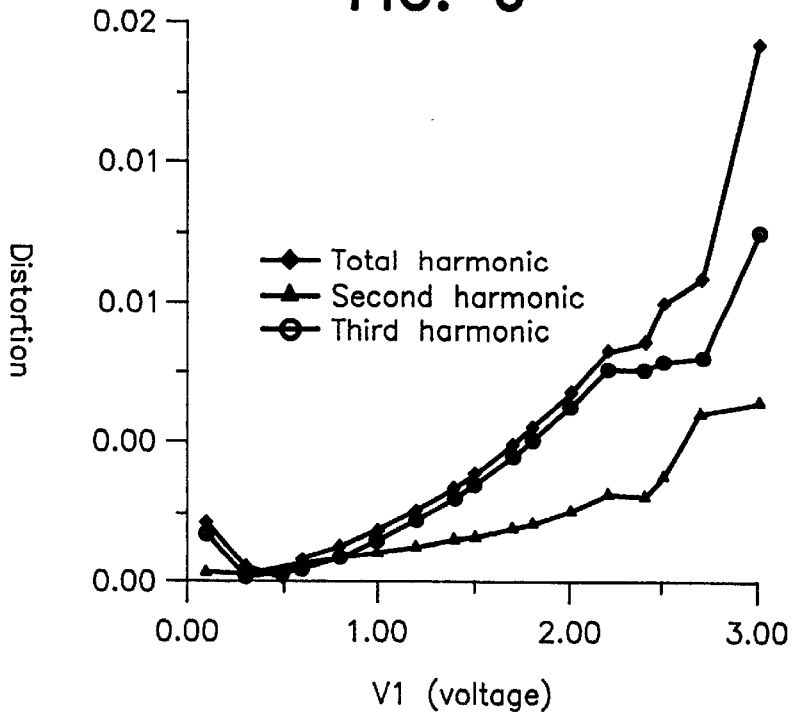
FIG. 6 illustrates a simulated analysis of the total harmonic distortion (THD) for the multiplier circuit shown in FIG. 4.

FIG. 6 illustrates an analysis of the total harmonic distortion (THD) for the simulated multiplier circuit 12. As can be seen in FIG. 6, when a sinusoidal input signal of 10 kHz is applied as differential voltage level $V_1$ to the multiplier 12, and a voltage of 2 V is applied as differential voltage level $V_3$ (the differential voltage levels $V_2$ and $V_4$ being zero), the multiplier circuit 12 provides an input range of up to 2.3 V with a THD of less than 1%. Thus, the simulation demonstrates that the multiplier circuit 12 provides an accurate multiplier with a wide input range and very little distortion.

Further, it was determined that the −3 dB bandwidth of the multiplier is approximately 5 MHz. Accordingly, the multiplier can be used as a modulator or a demodulator.

While certain preferred embodiments of the invention have been disclosed in detail, it will be understood that various modifications may be adopted without departing from the spirit of the invention or the scope of the following claims.

What is claimed is:

1. A four-quadrant multiplier, comprising:

a first differential input circuit having a first field effect transistor which produces a first drain current proportional to the square of a difference between a first gate voltage applied thereto and a first gate threshold voltage thereof, and a second field effect transistor which produces a second drain current proportional to the square of a difference between a second gate voltage applied thereto and a second gate threshold voltage thereof;

a second differential input circuit having a third field effect transistor which produces a third drain current proportional to the square of a difference between a third gate voltage applied thereto and a third gate threshold voltage thereof, and a fourth field effect transistor which produces a fourth drain current proportional to the square of a difference between a fourth gate voltage applied thereto and a fourth gate threshold voltage thereof;

a DC current supply circuit having two field effect transistors arranged to form a current mirror and having drains, two output nodes, and three constant current sources, each constant current source producing a same constant current, such that the DC current supply circuit provides the same constant current between each of the output nodes and a source supply voltage, and also provides the same constant current between a drain supply voltage and the drains of said two field effect transistors;

a current transfer circuit for producing an output current by subtracting the third and fourth drain currents from the sum of the first and second drain currents.

2. The multiplier as set forth in claim 1, wherein the first field effect transistor is biased by two NMOS field effect transistors and by two p-channel metal-oxide-semiconductor field effect transistors.

3. The multiplier as set forth in claim 1, wherein a gate of said second field effect transistor receives a differential input signal having a voltage level $V_2$, and a gate of said first field effect transistor receives a differential input signal having a voltage level $V_1$, source electrodes of said first and second field effect transistors being connected to a first one of said two output nodes of said DC current supply circuit.

4. The multiplier as set forth in claim 3, wherein a gate of said third field effect transistor receives a differential input signal having a voltage level $V_1$, and a gate of said fourth field effect transistor receives a differential input signal having a voltage level $V_2$, source electrodes of said third and fourth field effect transistors being connected to a second one of said two output nodes of said DC current supply circuit.

5. The multiplier as set forth in claim 4, wherein when the differential voltage level $V_1$ is applied to the gate of said fourth field effect transistor, and the differential voltage level $V_2$ is applied to the gate of said third field effect transistor, the third field effect transistor is activated to draw a drain current $I_1$, and the fourth field effect transistor is activated to draw a drain current $I_3$.

6. The multiplier as set forth in claim 5, wherein when the differential voltage level $V_1$ is applied to the gate of said first field effect transistor, and the differential voltage level $V_2$ is applied to the gate of said second field effect transistor, the second field effect transistor is activated to draw a drain current $I_2$, and the first field effect transistor is activated to draw a drain current $I_4$.

7. The multiplier as set forth in claim 6, said current transfer circuit comprising a plurality of transistors including a first transistor of said current transfer circuit connected to said first field effect transistor to draw drain current $I_4$, a second transistor of said current transfer circuit connected to said fourth field effect transistor to draw drain current $I_3$, a third transistor of said current transfer circuit connected to said third field effect transistor to produce source current $I_1$, and a fourth transistor of said current transfer circuit connected to said second field effect transistor to produce source current $I_2$.

* * * * *